US006382275B1

(12) United States Patent
Liao et al.

(10) Patent No.: US 6,382,275 B1
(45) Date of Patent: May 7, 2002

(54) WOOD PLANING MACHINE WITH A BED LOCKING UNIT WHICH IS ACTUATED BY A LEVER

(76) Inventors: Juei-Seng Liao, No. 295, Sec. 1, Nanking E. Rd.; Pei-Lieh Chiang, No. 12, Nan-Ping Rd., Nan., Dist., both of Taichung City (TW)

( * ) Notice: Subject to any disclaimer, the term of this patent is extended or adjusted under 35 U.S.C. 154(b) by 0 days.

(21) Appl. No.: 09/897,224

(22) Filed: Jul. 2, 2001

(30) Foreign Application Priority Data

May 18, 2001 (TW) ..... 090208190

(51) Int. Cl.[7] ..... B27C 1/00
(52) U.S. Cl. ..... 144/129; 144/117.1
(58) Field of Search ..... 144/114.1, 116, 144/117.1, 129, 130; 403/109.5, 110, 379.5

(56) References Cited

U.S. PATENT DOCUMENTS 5,829,498 A * 11/1998 Liao ..... 144/130
6,135,177 A * 10/2000 Chiang ..... 144/117.1 X
6,289,951 B1 * 9/2001 Chiang ..... 144/130

* cited by examiner

*Primary Examiner*—W Donald Bray
(74) *Attorney, Agent, or Firm*—Trop, Pruner & Hu, P.C.

(57) ABSTRACT

A planing machine includes a support bed disposed movably along two pairs of vertical slots which are formed through two side walls of a machine body. A-bed-raising rod unit is operably associated with the bed in such a manner that rotation of the rod unit results in movement of the bed within the machine body. Two horizontally spaced apart and interconnected locking rods extend through the bed and the slots in the side walls, and have left and right threaded ends of opposite thread directions. The threaded ends of the locking rods are exposed from the slots in the side walls. Left and right nut units are disposed outside of the machine body, are mounted threadedly on the threaded ends of the locking rods in such a manner that rotation of the locking rods result in axial movement of said left and right nut units toward or away from each other.

4 Claims, 8 Drawing Sheets

WOOD PLANING MACHINE WITH A BED LOCKING UNIT WHICH IS ACTUATED BY A LEVER

CROSS-REFERENCE TO RELATED APPLICATION

This application claims priority of Taiwan Application No. 90208190, filed on May 18, 2001.

BACKGROUND OF THE INVENTION

1. Field of the Invention

The invention relates to a wood planing machine, more particularly to a wood planing machine with a bed locking unit which has a simple structure.

2. Description of the Related Art

Referring to FIG. 1, a conventional wood planing machine 10 is shown to include a machine body 11, a workpiece-support bed 13, a cutter unit 14, a bed-raising unit 15, and a bed-locking unit 16.

As illustrated, the machine body 11 has a pair of spaced apart side walls 12, each of which is formed with a pair of vertical slots 121 therethrough. The workpiece-support bed 13 is disposed movably in the machine body 11 between the side walls 12 and under the cutter unit 14. The bed-locking unit 16 secures the bed 13 to the side walls 12.

The bed-raising unit 15 is associated with the workpiece-support bed 13 for adjusting the height of the bed 13 relative the cutter unit 14.

The bed-locking unit 16 includes left and right pairs of engaging pieces 161 which are fixed on the left and right portions of the workpiece-support bed 13, which extend into the slots 121, and which are formed with screw holes, and left and right pairs of clamping plates 162 which are disposed on outer sides of the side walls 12 and which threadedly engage the screw holes in the engaging pieces 161. The clamping plates 162 are provided with turning handles 163.

When a desired height of the workpiece-support bed 13 relative to the cutter unit 14 has been achieved, each of the clamping plates 162 is turned in a clockwise direction, where the clamping plates 162 are forced to abut against the side walls 12 so as to lock the workpiece-support bed 13 relative to the side walls 12. It is inconvenient and time-consuming to turn the clamping plates 162 one after another.

SUMMARY OF THE INVENTION

Therefore, the object of this invention is to provide a wood planing machine which includes a bed-locking unit of a simple construction and which is clear of the aforementioned drawback that results from the use of the conventional wood planing machine.

Accordingly, the wood planing machine of the present invention includes a machine body with opposite side walls, a workpiece-support bed, a bed-raising unit, and a bed locking unit. Each of the side walls has a pair of vertical slots formed therethrough. The workpiece-support bed is disposed between the side walls, and is movable along the slots. The bed-raising unit is mounted on the machine body, and is operably associated with the workpiece-support bed in such a manner that operation of the bed-raising unit results in movement of the workpiece-support bed within the machine body. The bed locking unit includes two horizontally spaced apart and interconnected locking rods, and left and right nut units. The locking rods extend through the workpiece-support bed and the slots in the side walls, and have left and right threaded ends of opposite thread directions. The threaded ends of the locking rods are exposed from the slots in the side walls. The locking rods are axially rotatable. The left and right nut units are disposed outside of the machine body adjacent to the left and right side walls, respectively, and include a pair of internally threaded right nuts which are mounted threadedly on the right threaded ends of the locking rods and disposed non-rotatably on the machine body and which have wall abutting flanges extending outwardly and radially from the right nuts, and a pair of internally threaded left nuts which are mounted threadedly on the left threaded ends of the locking rods and disposed non-rotatably on the machine body and which have wall abutting flanges extending outwardly and radially from the left nuts. Rotation of the locking rods results in axial movement of the left and right nut units toward or away from each other and consequently causes the wall abutting flanges of the left and right nuts to engage or disengage the side walls, thereby locking or unlocking the workpiece-support bed on the side walls of the machine body.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
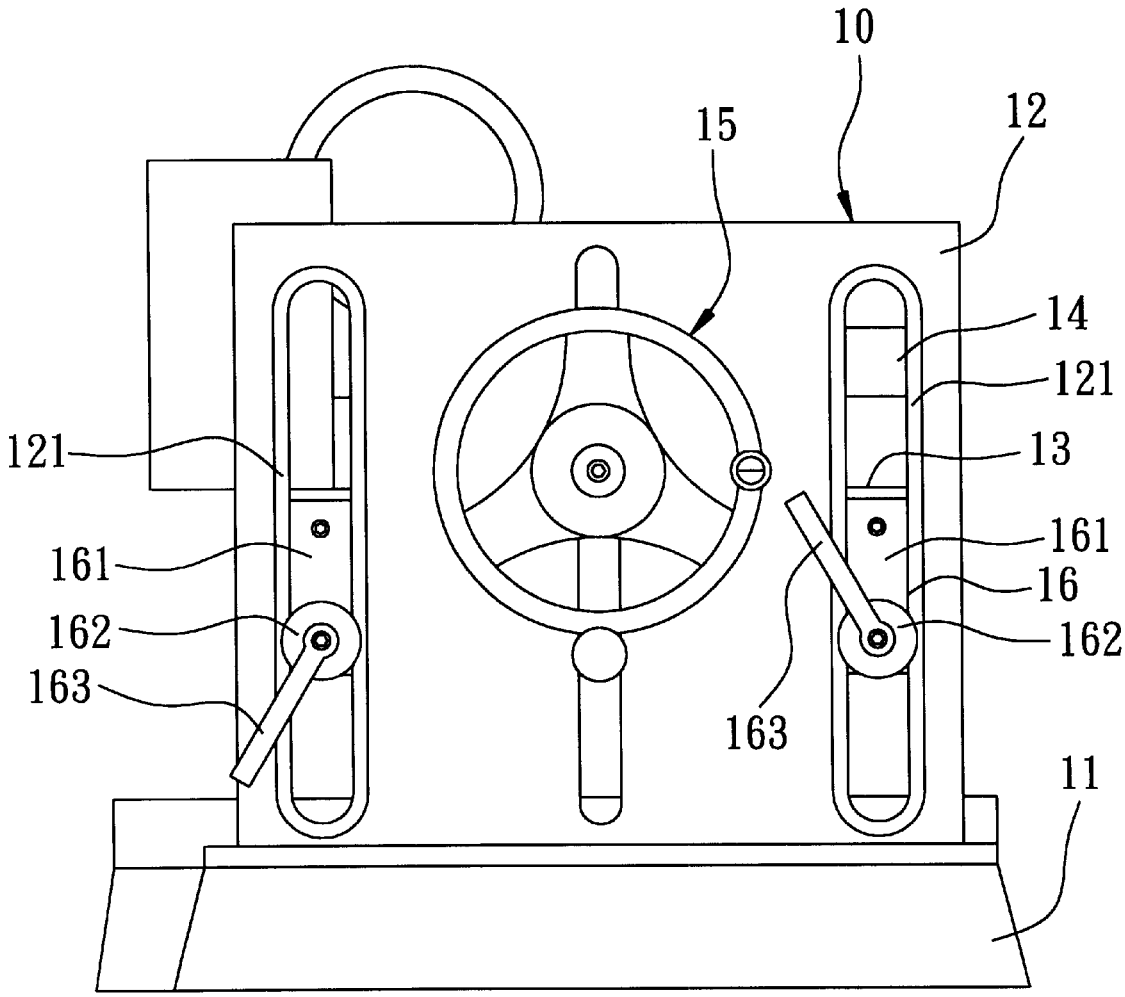
FIG. 1 PRIOR ART
FIG. 1 is a schematic side view of a conventional wood planing machine.
Figure 2:
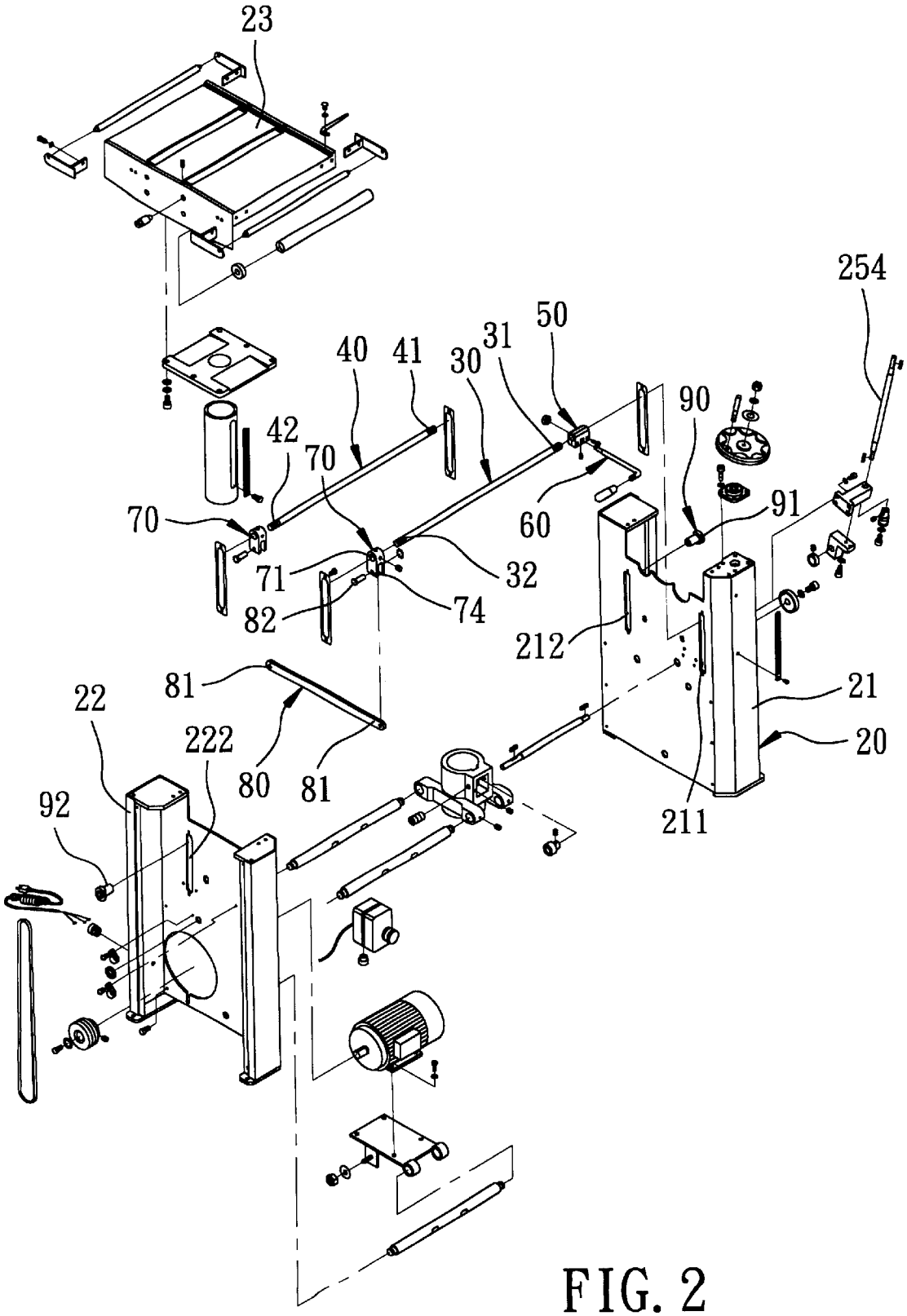
FIG. 2 is a fragmentary exploded view of a preferred embodiment of a wood planing machine of the present invention.
Figure 3:
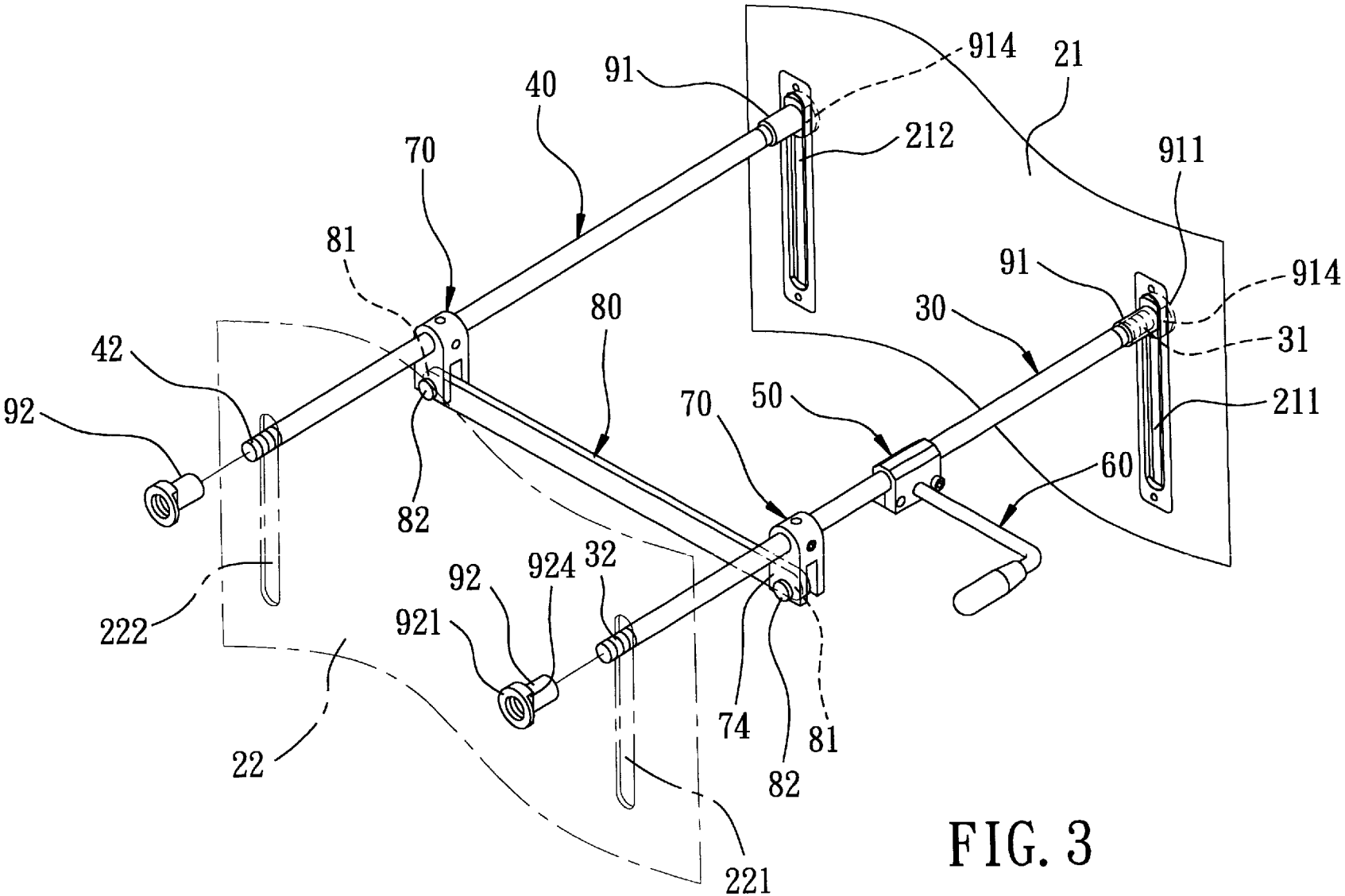
FIG. 3 is a fragmentary perspective view of the preferred embodiment, illustrating how a bed-locking unit is mounted on a machine body with a workpiece-support bed removed therefrom for the sake of clarity.
Figure 4:
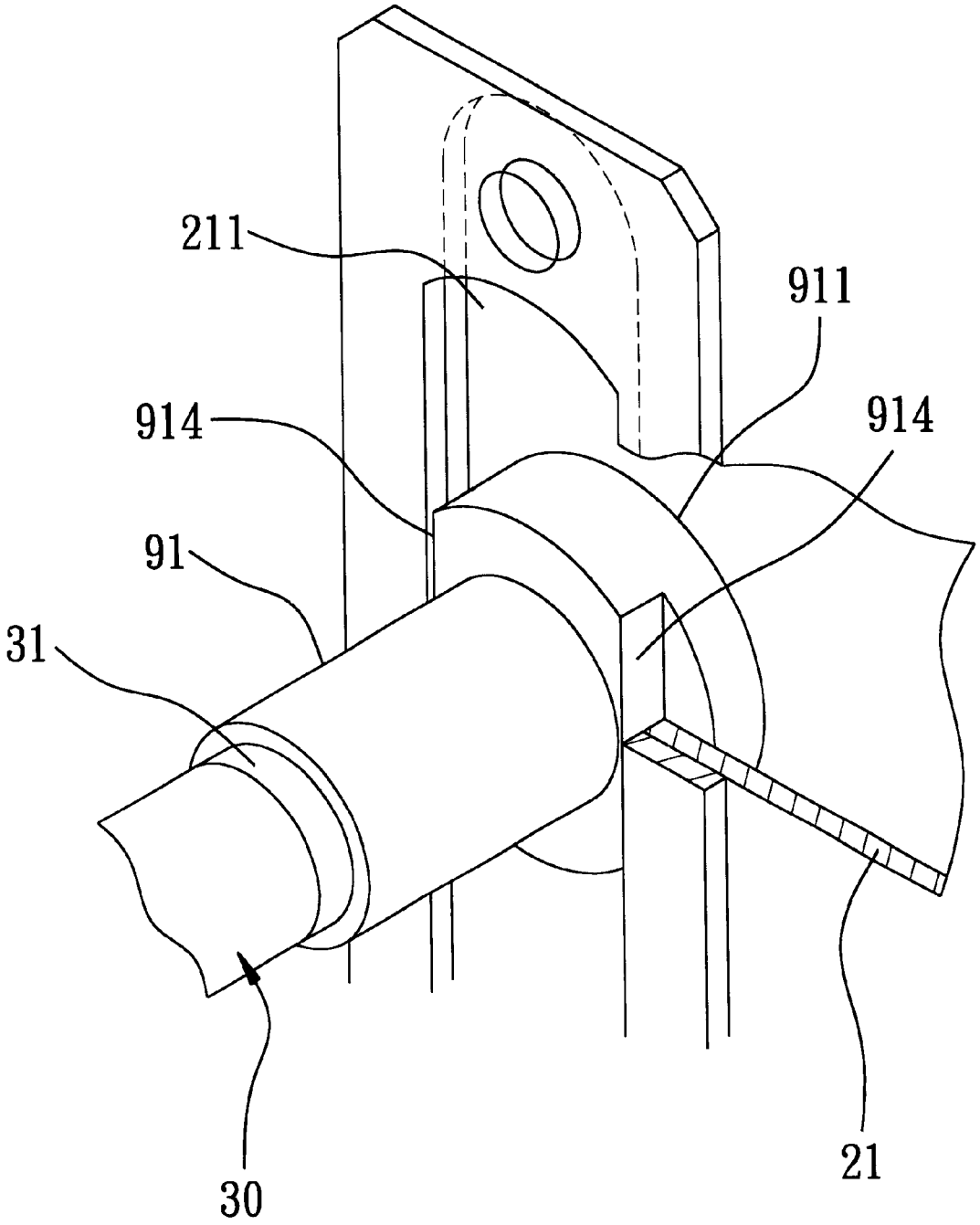
FIG. 4 is an enlarged view of a portion of the bed-locking unit shown in FIG. 3.

Referring to FIGS. 2 to 5, the preferred embodiment of a wood planing machine of this invention is shown to include an elongated machine body 20, a cutter unit (not shown), a workpiece-support bed 23, a bed-raising unit 254, and a bed locking unit.

As illustrated, the machine body 20 includes left and right side walls 21,22, each of which has a pair of vertical slots (211,212), (221,222) formed therethrough.

A cutter unit (not shown) is mounted operably on the machine body 20 between the side walls 21,22 in a conventional manner.

The workpiece-support bed 23 is disposed between the side walls 21, 22 below the cutter unit (not shown) and is movable along the slots (211,212), (221,222) so as to achieve a desired height of the workpiece-support bed 23 relative to the cutter unit.

The bed-raising unit 254 is mounted on the machine body 20, and is operably associated with the support bed 23 in such a manner that operation of the bed-raising unit 254 results in movement of the workpiece-support bed 23 within the machine body 20. The structures of the workpiece-support bed 23 and the bed-raising unit 254 and the connecting relationship therebetween are described in U.S. Pat. No. 6,135,177 and since the present invention is not pertinent thereto, a detailed description of the same is omitted herein for the sake of brevity.

The bed locking unit includes two horizontally spaced apart and interconnected locking rods (30,40), and left and right nut units 90. The locking rods 30, 40 extend through the workpiece-support bed 23 and the slots (211,212), (221, 222) in the side walls (21,22), and have left and right threaded ends (31,41), (32,42) of opposite thread directions. The threaded ends (31,41), (32,42) are exposed from the machine body 20 via the slots (211,212), (221,222) in the side walls 21,22. The locking rods 30,40 are axially rotatable. The left and right nut units 90 are disposed outside of the machine body 20 adjacent to the side walls 21,22, respectively, and include a pair of internally threaded left nuts 91 which are mounted threadedly on the left threaded ends 31,41 of the locking rods 30,40 and disposed non-rotatably on the machine body 20 and which have wall abutting flanges 911 extending outwardly and radially from the left nuts 91, and a pair of internally threaded right nuts 92 which are mounted threadedly on the right threaded ends 32,42 of the locking rods 30,40 and disposed non-rotatably on the machine body 20 and which have wall abutting flanges 921 extending outwardly and radially from the right nuts 92. Rotation of the locking rods 30, 40 results in axial movement of the left and right nuts 91,92 toward or away from each other and consequently causes the wall abutting flanges 911, 921 of the nuts 91, 92 to engage or disengage the side walls 21,22, thereby locking or unlocking the workpiece-support bed 23 on the side walls 21,22. Preferably, a lever 60 is fixed to one of the locking rods 30,40 by means of a fixed lever-mounting element 50 to facilitate turning of the rods 30,40.

Each of the left and right nuts 91,92 has a pair of axially extending outer parallel side walls 914, 924 which extend into a respective one of the slots (211,212), (221,222) in the side walls 21,22 for guiding movement of the left and right nuts 91,92 in the slots (211,212), (221,222). Two coupling elements 70 are respectively fixed on the locking rods 30,40. Each coupling element 70 has a pair of downwardly extending lugs 74. Two opposite ends 81 of a coupling rod 80 are pivoted to the lugs 74 of the coupling elements 70 by two pivots 82.

Figure 5:
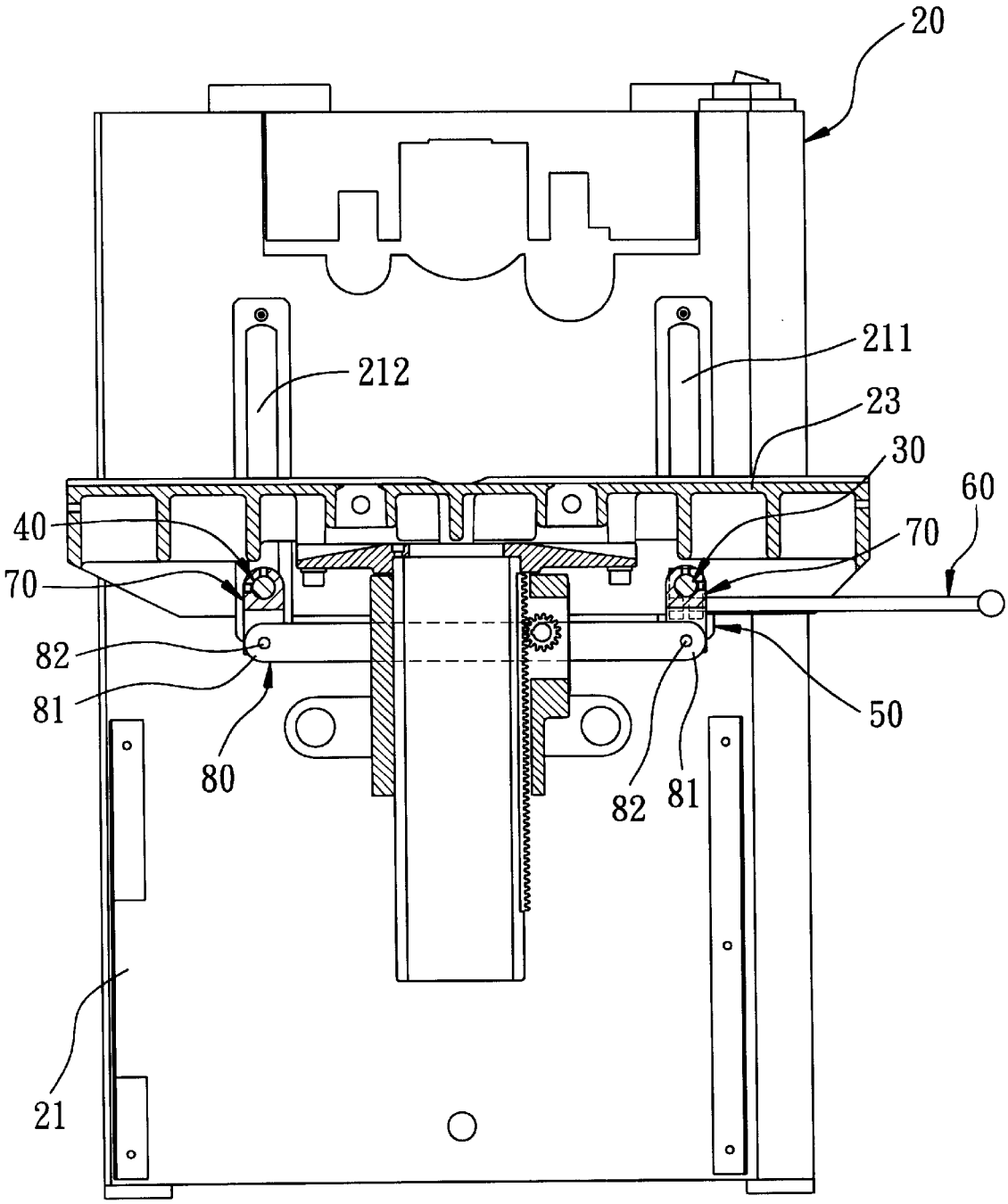
FIG. 5 is a schematic partly sectional side view of the preferred embodiment, illustrating connection relationship between a workpiece-support bed and the bed-locking unit when the workpiece-support bed is locked relative to the machine body.
Figure 6:
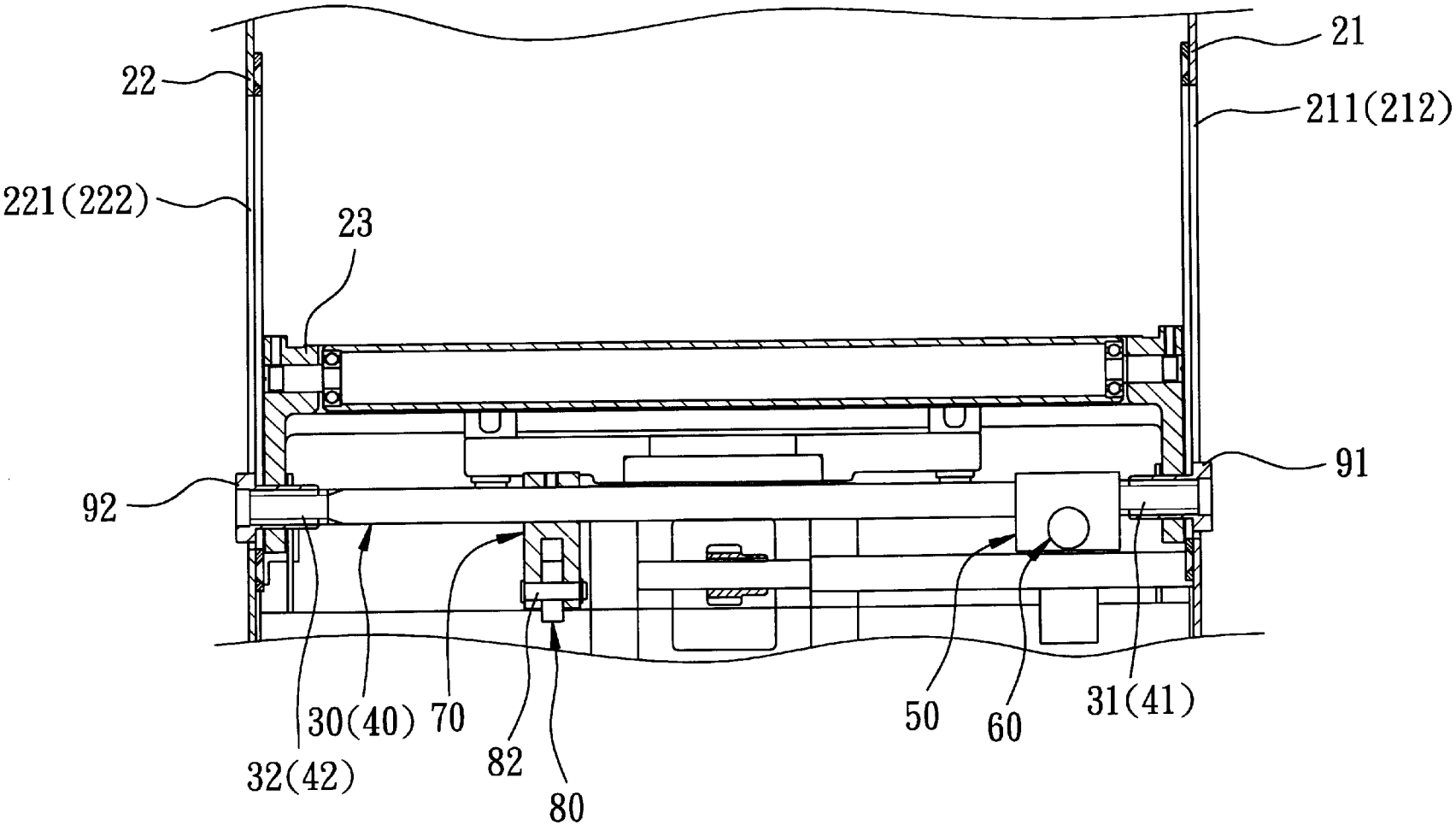
FIG. 6 is a fragmentary partly sectional front view of the preferred embodiment, illustrating the connection relationship between the workpiece-support bed and the bed-locking unit when the workpiece-support bed is locked relative to the machine body.

As best shown in FIG. 5, after a desired height of the workpiece-support bed 23 relative to the cutter unit (not shown) has been achieved by virtue of operation of the bed-raising unit 254, the lever 60 is turned in an anti-clockwise direction so as to rotate the locking rods 30,40 in a first direction such that the left and,right nuts 91,92 move axially toward each other and force against the side walls 21,22 (see FIG. 6). The workpiece-support bed 23 is locked on the side walls 21,22 at this time.

Figure 7:
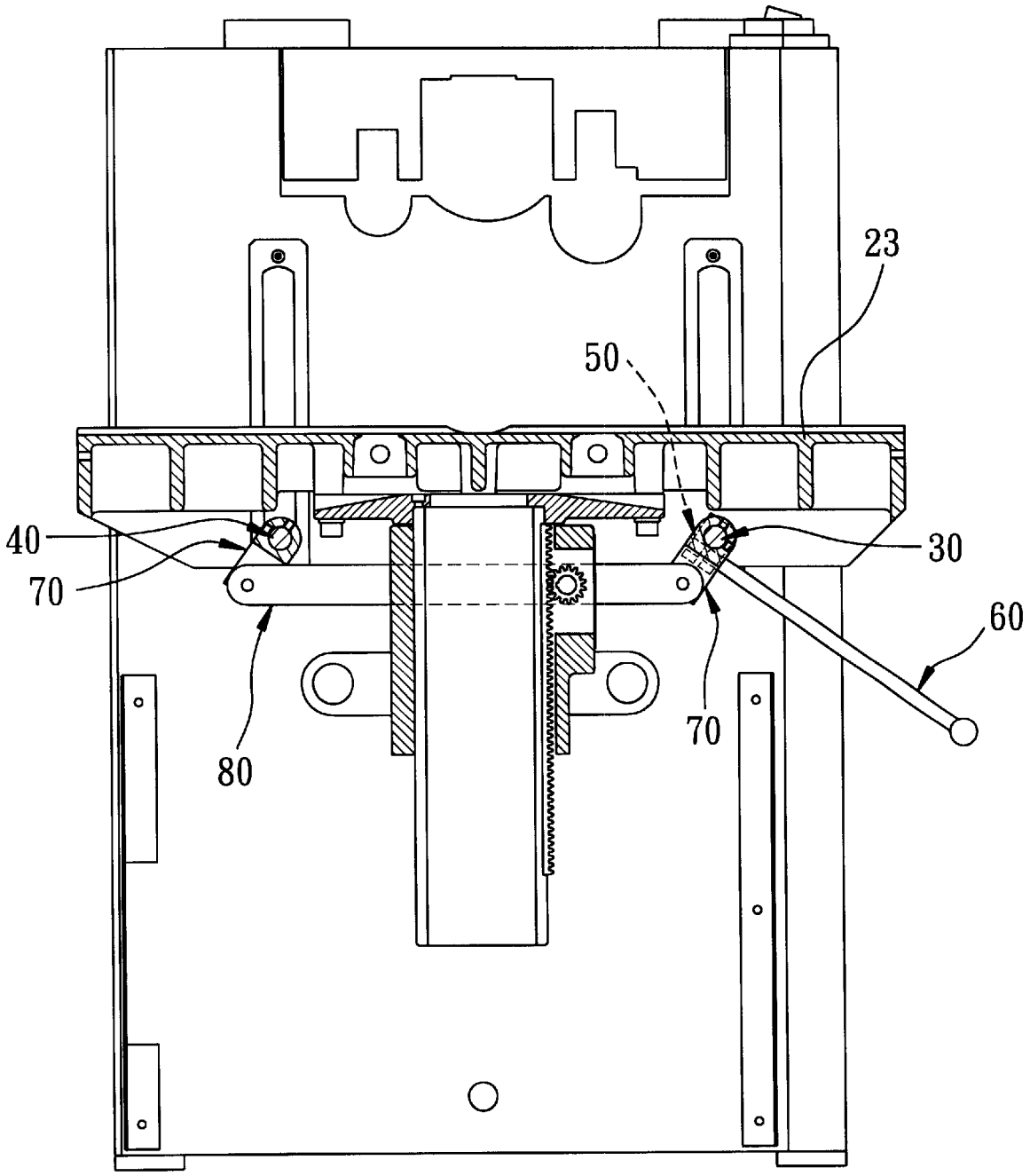
FIG. 7 is a schematic partly sectional side view of the preferred embodiment, illustrating the connection relationship between the workpiece-support bed and the bed-locking unit when the workpiece-support bed is released relative to the machine body.
Figure 8:
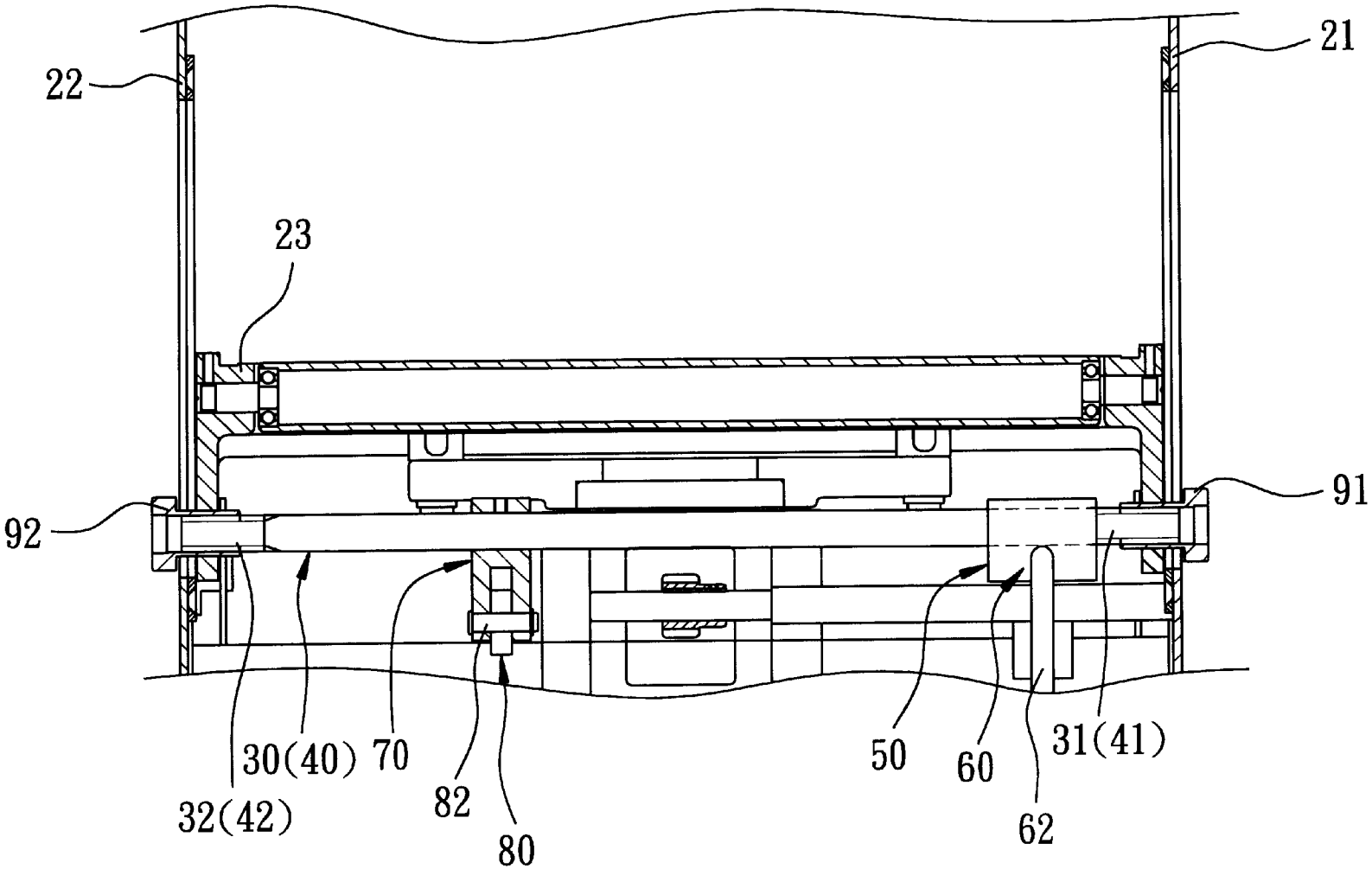
FIG. 8 is a fragmentary partly sectional front view of the preferred embodiment, illustrating the connection relationship between the workpiece-support bed and the bed-locking unit when the workpiece-support bed is released relative to the machine body.

As best shown in FIG. 7, when it is desired to unlock the workpiece-support bed 23 from the side walls 21,22, the lever 60 can be turned in a clockwise direction so as to rotate the locking rods 30,40 in a second direction such that the left and right nuts 91,92 move axially away from each other and consequently disengage the side walls 21,22 (See FIG. 8).

Note that the bed-locking unit of the present invention is simple in construction and is easy to operate as compared to the bed-locking unit of the conventional wood planing machine. The object of the present invention is thus achieved.

With this invention thus explained, it is apparent that numerous modifications and variations can be made without departing from the scope and spirit of this invention. It is therefore intended that this invention be limited only as indicated in the appended claims.

We claim:

1. A wood planing machine comprising:

a machine body with opposite side walls, each of which has a pair of vertical slots formed therethrough;

a workpiece support bed disposed between said side walls and movable along said slots;

a bed-raising unit mounted on said machine body and operably associated with said support bed in such a manner that operation of said bed-raising unit results in movement of said support bed within said machine body; and a bed locking unit including two horizontally spaced apart and interconnected locking rods which extend through said support bed and said slots in said side walls and which have left and right threaded ends of opposite thread directions exposed from said slots in said side walls, said locking rods being axially rotatable, and left and right nut units disposed outside of said machine body adjacent to said left and right side walls respectively, and including a pair of internally threaded right nuts which are mounted threadedly on said right threaded ends of said locking rods and disposed non-rotatably on said machine body and which have wall abutting flanges extending outwardly and radially from said right nuts, and a pair of internally threaded left nuts which are mounted threadedly on said left threaded ends of said locking rods and disposed non-rotatably on said machine body, and which have wall abutting flanges extending outwardly and radially from said left nuts, rotation of said locking rods resulting in axial movement of said left and right nut units toward or away from each other and consequently causing said wall abutting flanges to engage or disengage said side walls, thereby locking or unlocking said bed on said side walls.

2. The wood planing machine as defined in claim 1, further comprising a lever fixed to one of said locking rods to facilitate turning of said locking rods.

3. The wood planing machine as defined in claim 2, further comprising a pair of coupling elements which are fixed on said locking rods and each of which has a pair of downwardly extending lugs, and a coupling rod which has two opposite ends pivoted to said lugs of said coupling elements.

4. The wood planing machine as defined in claim 1, wherein each of said left and right nuts has a pair of axially extending outer parallel side walls extending into a respective one of said slots in said side walls for guiding movement of said left and right nut units along said slots.

* * * * *